United States Patent [19]

Johansson

[11] 4,363,279

[45] Dec. 14, 1982

[54] METHOD OF POSITIVELY CONTROLLING, STORING AND TRANSPORTING BANKNOTES, AND A SAFETY CASSETTE AND BANKNOTE-INFEED UNIT FOR CARRYING OUT THE METHOD

[75] Inventor: Sven L. Johansson, Stockholm, Sweden

[73] Assignee: Innovationsteknik, Stockholm, Sweden

[21] Appl. No.: 199,783

[22] PCT Filed: Oct. 19, 1979

[86] PCT No.: PCT/SE79/00211

§ 371 Date: Jun. 20, 1980

§ 102(e) Date: Jun. 20, 1980

[87] PCT Pub. No.: WO80/00887

PCT Pub. Date: May 1, 1980

[30] Foreign Application Priority Data

Oct. 20, 1978 [SE] Sweden ..... 7810981

[51] Int. Cl.[3] ..... G07D 9/00; G07F 9/06; E05G 1/00; E05G 1/12

[52] U.S. Cl. ..... 109/29; 109/20

[58] Field of Search ..... 109/25, 29, 30, 36, 109/37, 20

[56] References Cited

U.S. PATENT DOCUMENTS

| | | | |
|---|---|---|---|
| 901,778 | 10/1908 | Bucknam . | |
| 1,548,219 | 8/1925 | Soderquist . | |
| 2,384,826 | 9/1945 | Ferguson . | |
| 3,559,593 | 2/1971 | Munton | 109/25 |
| 3,587,484 | 6/1971 | Munton | 109/25 |
| 3,643,609 | 2/1972 | Maywald | 109/29 |
| 3,650,226 | 3/1972 | Conroy | 109/25 |
| 3,654,880 | 4/1972 | Schesso | 109/25 |
| 3,732,830 | 5/1973 | Lindstedt | 109/36 |
| 3,783,884 | 1/1974 | Carlberg | 133/1 |
| 3,841,550 | 10/1974 | Kaneda | 232/15 |

FOREIGN PATENT DOCUMENTS

| | | |
|---|---|---|
| 277082 | 7/1914 | Fed. Rep. of Germany . |
| 399790 | 7/1924 | Fed. Rep. of Germany . |
| 825017 | 12/1951 | Fed. Rep. of Germany . |
| 2202930 | 1/1972 | Fed. Rep. of Germany . |
| 531092 | 6/1975 | Japan . |
| 526298 | 7/1975 | Japan . |
| 57930 | 12/1920 | Sweden . |
| 376780 | 6/1975 | Sweden . |
| 380917 | 11/1975 | Sweden . |
| 381760 | 12/1975 | Sweden . |

*Primary Examiner*—Reinaldo P. Machado
*Attorney, Agent, or Firm*—Sughrue, Mion, Zinn, Macpeak and Seas

[57] ABSTRACT

In a method of providing safe control, storage and transportation of banknotes there is used a closeable cassette (1) provided with locking means, said cassette containing a liquid-dye container (9) which is activated when an attempt is made to force the cassette, thereby to render the banknotes unusable. To prevent a successful robbery against, for example, a store or like place in which banknotes are introduced into the cassette with the aid of a special infeed unit (19, 20), the cassette is constructed so that it can be removably connected to said infeed unit while exposing an infeed opening (16), said infeed unit suitably being provided with a counter means. In conjunction therewith, the associated infeed and packing means of the cassette are inserted into the unit, whereupon banknotes can be fed into the cassette. The cassette, with the banknotes therein, is then released from the infeed unit while closing the infeed opening, whereafter the cassette is transported to a collecting location, e.g. a bank, where an authorized person equipped with a key or a code for the cassette lock (1c) empties the cassette of its contents.

The safety function of the cassette includes an electric circuit arranged, when an attempt is made to force the cassette, to ignite a detonator (8) which ruptures the liquid-dye container. The electric safety function is primed automatically when the cassette is closed as it is removed from the infeed unit.

The invention also relates to a safety cassette (1) and an infeed unit (19, 20) for carrying out the method.

10 Claims, 3 Drawing Figures

METHOD OF POSITIVELY CONTROLLING, STORING AND TRANSPORTING BANKNOTES, AND A SAFETY CASSETTE AND BANKNOTE-INFEED UNIT FOR CARRYING OUT THE METHOD

The present invention relates to a method of safely controlling, storing and transporting banknotes and other valuable papers. Different kinds of cassettes, safety-boxes and safety-dispatch cases provided with different kinds of security systems, including a container which contains a dye or some other colouring substance and which is arranged to release the liquid over said banknotes upon forced or unauthorized entry into the cassette, thereby rendering the banknotes useless or readily identifiable, are previously known from, for example, U.S. Pat. Nos. 1,548,219, 2,384,826, 3,559,593, 3,654,880 and 3,643,609.

The disadvantage with these known devices, however, is that they do not provide a fully reliable handling system for banknotes and other valuable papers from a pick-up station or a pay-in station, such as the pay-counter of a shop or store, or a post-office or bank, to a place where the banknotes or papers can be received in safety, such as in a bank vault.

As is well known, robberies are often directed against shops and post-offices and banks. The natural reason for this is that ready money is on hand at such places, even though some kind of safety cassette of the aforementioned type is used to transport the money to, for example, a bank.

Further disadvantages with the aforementioned known cassettes and dispatch boxes or cases is that they are, as a rule, relatively large and bulky and cannot therefore be deposited in the reception boxes of the banks or in letter-boxes for normal postal delivery.

Other kinds of similar banknote and coin collecting devices encumbered with corresponding disadvantages are described in U.S. Pat. Nos. 901,778, 3,783,884 and 3,841,550, Japanese Patent publication Nos. 52-16298 and 53-1092, German Patent specifications 277 082, 399 790, 825 017, German Published application No. 2 202 930 and Swedish Patent specification and Published specification Nos. 57 930, 376 780, 380 917 and 381 760.

The object of the present invention is to provide a method of the aforedescribed kind which eliminates the aforementioned disadvantages and which permits safe control, storage and transportation of banknotes and other valuable papers from a banknote pick-up station, such as a cash register on a store counter, to, e.g., a bank vault.

A further object is to provide a method of the aforementioned kind while applying an improved and more effective safety function in the cassette itself.

Because, in accordance with the invention, the infeed opening of the cassette is only exposed when the cassette is introduced into the infeed unit and because said cassette cannot be released from said unit without reclosing the cassette which also effects priming of the electric safety function, it is not possible in the case of a robbery or like criminal action for an unauthorized person to have access to the money present in a cassette which is connected to an infeed unit. This means that a robbery directed for instance against a store which applies the method according to the invention, i.e. a store having an infeed unit of the aforedescribed kind, is futile in practice since, with the exception of a cash box with little content, the thief can only take one or more closed cassettes which cannot be opened by him without rendering the contents thereof useless.

Thus, the invention provides a considerably improved security system for storing and transporting banknotes.

Further, because the banknotes are fed into the cassette by means of a unit which is separate from the cassette, it is possible to use small and readily handled cassettes; in practice the length and width of the cassette need only slightly exceed the length and width of the largest banknote which is to be stored in the cassette. The cassette may have any depth, said depth being chosen with respect to the number of banknotes which it is desired to hold. Normally, however, the depth of the cassette is preferably chosen to enable the cassette to be readily introduced into the opening of a safety deposit box associated with a bank vault or into the mouth of a letter-box. Thus, if desired the cassette can also be sent by post, since unauthorized persons attempting to break open the cassette gain no advantage thereby.

Further advantages obtained with the use of separate infeed units include a reduction in costs, since it is not necessary to provide each cassette with a separate infeed part and counter. Instead, the separate infeed unit can serve a plurality of cassettes, the aforementioned special security function being obtained at the same time.

The safety functions of the cassette shall primarily come into operation when the following circumstances prevail:

when the cassette casing is forced, when an attempt is made to open the cassette lock without using the correct key or code, when the cassette is subjected to low temperatures in an attempt to freeze the dye liquid or to lower the capacity of the battery such that the detonator for rupturing the dye container is not ignited.

One important characterizing feature of the cassette is that the outer surfaces of the cassette shall be substantially smooth and imperforate, i.e. shall lack holes or projections which would assist in any attempt to force open the cassette.

The cassette locking means may be one of a number of different kinds of such means. Preferably, however, the cassette is provided with a locking means which has no external openings, such as keyholes or the like which might assist in an attempt to force the cassette or which might enable a substance capable of rendering the safety functions unserviceable to be introduced into the cassette. Preferably, the cassette is provided with an optolock capable of being opened by an authorized person, by bringing a light sensor against a device having a light-coding system. In this way, the safety function is de-activated, allowing the cassette to be opened.

The cassette which is preferred in practice has a separate cover-plate for closing the infeed opening. Thus, the cassette is separated from this cover-plate in the infeed part. Conveniently two switches are arranged on the connecting surfaces of the remaining banknote part of the cover-plate and the cassette. If any attempt is made to remove the cover-plate before de-activating the safety function, the detonator will be ignited.

Further, the cassette is conveniently provided with a micro-processor in which, inter alia, the aforementioned light-coding function is programmed. The micro-processor is also used to co-ordinate other functions.

The cassette is preferably also provided with a separate banknote holding means which, in practice, may comprise a combined holding means for the dye container, the detonator and the sensing means, said holder having the form of a sheet metal casing. The holding means is first provided with its respective devices and is then introduced into the banknote part of the cassette. The holding means is so constructed that it abuts the inner surfaces of the banknote part, and is provided on the leading edge thereof with an attachment means. The holding means is also provided with two elongate support edges. When loading the cassette with banknotes, the banknotes are fed one at a time in under said support edges and out onto a packing plate.

Subsequent to fully feeding a banknote into the cassette, the packing plate urges the banknote up over the support edges, so that the banknote rests thereupon. A further banknote can then be introduced into the cassette subsequent to the packing plate returning to its starting position. Arranged in the roof of the banknote holding means is a reaction surface which, when the banknote holding means is full, presses the banknotes against a sensing device in the packing plate.

In a preferred embodiment, the dye liquid container and the detonator are arranged externally on walls which form guide surfaces for the banknotes introduced thereinto. These walls are provided with apertures to permit the dye liquid to pass through said walls. The dye liquid container may be made of a plastics material and provided with weakened portions or rupture lines so arranged that the liquid is thrown over the bundle of banknotes in said cassette when the container is ruptured. The detonator is arranged adjacent the dye container and is ignited electrically upon receipt of a signal from the safety function.

The cassette is provided with a temperature-sensing device arranged to ignite the detonator if the cassette is subjected to very low temperatures in an attempt to render the safety system of the cassette inoperative.

For the purpose of limiting the amount of current consumed in an empty cassette, the cassette is preferably provided with a means for sensing when the cassette is empty. The safety functions are activated when the first banknote is introduced into the cassette.

In an alternative embodiment the safety functions, as before-mentioned, are activated in conjunction with removing the cassette from the infeed part.

The invention also relates to an infeed unit arranged to cooperate with a cassette for carrying out the aforedescribed method. The main characterizing features of the infeed unit are disclosed in the following claims.

In a preferred embodiment, the frame of the infeed unit and the cassette receiving part comprise a housing having a recess in which the cover-plate of the cassette is accommodated when inserting the cassette. When the banknote part of the cassette is lowered to the position for receiving banknotes, the said cover-plate remains in said recess. The cover-plate or banknote part cannot then be separately removed from their respective positions. Thus, when the cassette is to be removed, the banknote part must be moved up towards said cover-plate guiding or occupying position so that the cover-plate completely covers the opening in the banknote part.

The infeed unit can be provided with any one of a number of counter means.

For example, the infeed unit can be provided with a counter means having a display and a press-button for the value of each banknote. When a banknote or a bundle of banknotes of given value is or are placed on an infeed surface associated with the infeed part, the said push-button of the respective counter means is depressed. The banknotes are then fed in and the feed will automatically stop when the banknote or all the banknotes in the bundle has or have been fed in to the cassette. Thus, the correct counter must again be depressed for each new banknote or bundle of banknotes.

Alternatively, there can be used an automatic counter means arranged to measure the length of a banknote and therewith its value, and automatically show the number of banknotes of different denomination in separate displays or windows. Optionally, the total sum of the banknotes fed into the unit can also be indicated. In the case of this system, the infeed of banknotes is started automatically as soon as a banknote or a bundle of banknotes is placed on the infeed surface, and terminates automatically upon completion of the infeed operation.

The infeed and packing part are preferably mounted on a movable frame arranged for movement towards or away from the infeed position and suitably guided by a system of guides. Alternatively, the infeed and packing part may be fixedly arranged and the cassette itself arranged for movement such that the infeed and packing part is partially received therein.

In case of the firstmentioned alternative, when a cassette is to be introduced into the infeed unit, the frame must be located in its rearmost position before the banknote part of the cassette is moved down to the infeed level. The frame is then moved to its forward position, the packing part entering the banknote part of the cassette. Introduction of banknotes into the cassette can then commence.

In a preferred embodiment, the infeed unit is provided with a raisable banknote-supporting surface. A sensing means for detecting the arrival of banknotes on said surface may be arranged therebeneath.

The infeed part is also preferably provided with infeed rollers arranged to separate the banknotes and to feed said banknotes into said cassette one at a time. Further, there may be provided a read-off means which detects the passage of a banknote and which is arranged to transmit a signal to a packing means with a given time delay. The same read-off means may also be arranged to send a signal to the counter function of the infeed part.

The packing means, which is located behind the last infeed roller in line, may comprise a plate which is suspended from a linkage system arranged to co-operate with an eccentric. The infeed rollers and the packing devices may be driven by separate motors.

The infeed part is also suitably provided with an electronic function arranged to receive signals from the aforementioned various sensing devices actuated when banknotes are fed into and packed in the cassette. The sensor which controls the packing of banknotes in the cassette may also be arranged to send a signal to the counter. An infeed unit provided with an automatic counter means may also include a micro-processor arranged to sort the signals from the sensing means for banknotes of different lengths, to a memory store for each banknote denomination. The micro-processor may also be used to coordinate the different electronic functions.

The infeed unit is also provided with a mains unit or power pack, comprising transformers, rectifiers and divers electronic components. The unit may for instance be arranged to be connected to a single-phase 220 V 50 Hz.

An exemplary embodiment of the invention will now be described with reference to the accompanying drawing.

Figure 1:
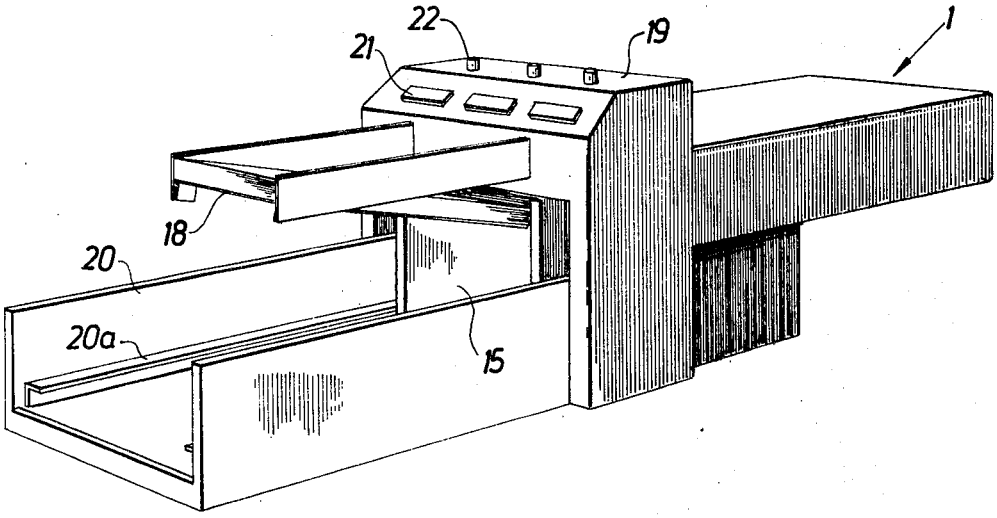
FIG. 1 is a perspective view of an infeed unit in which a cassette has been inserted to a position for the infeed of banknotes.
Figure 3:
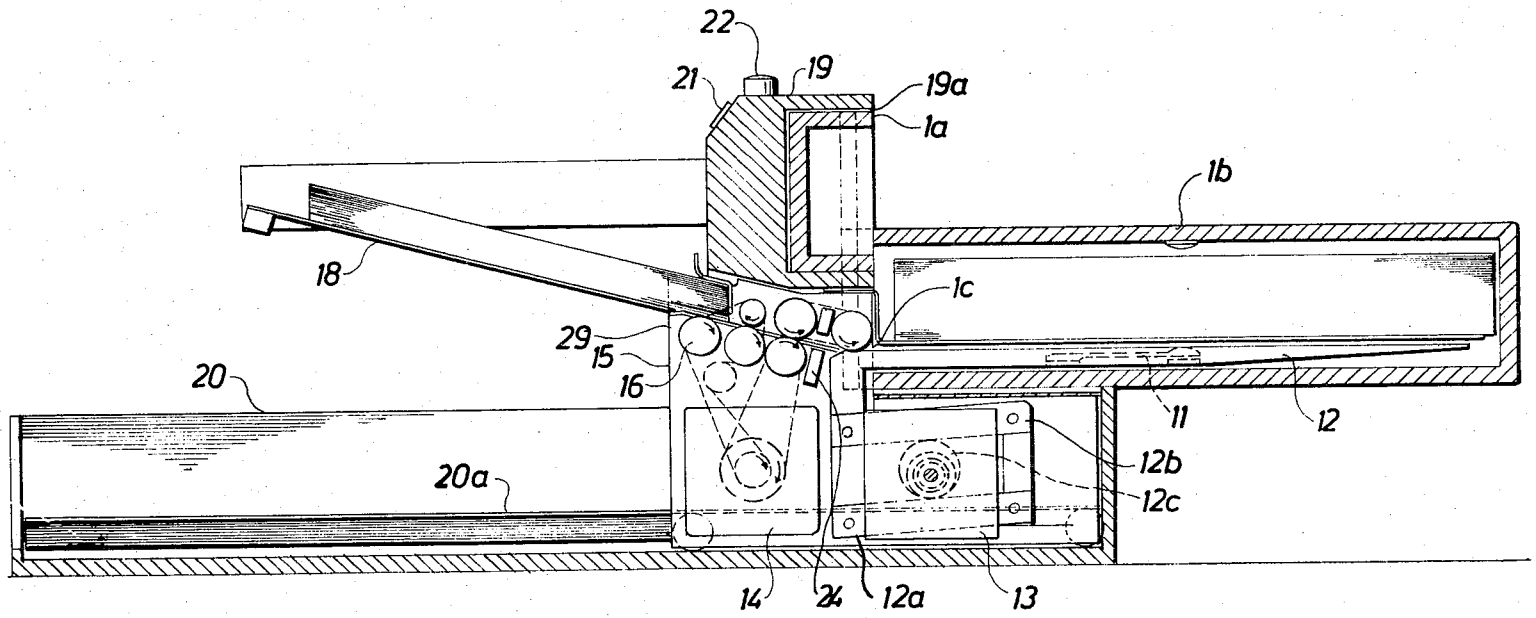
FIG. 3 is a vertical sectional view of an infeed unit in which a cassette has been inserted to a position for the infeed of banknotes.

The infeed unit shown in FIG. 1 has inserted therein a cassette 1 and comprises a frame part or a housing 19 having a mounting plate 20. An infeed part having packing means 15 is displaceably movable relative to the housing 19 and the plate 20. In the illustrated embodiment, the infeed part and the packing means 15 are mounted on a movable frame which is arranged for movement to or from the infeed position on a guide system 20*a* located on the mounting plate 20. Arranged on the housing wall in front of the frame is a raisable banknote-supporting surface 18. Located beneath the surface 18 is a sensing means 29 (FIG. 3) which detects the arrival of banknotes on the support surface 18. Inside the frame there are arranged infeed rollers 16, said rollers being arranged to separate the banknotes and to feed them into the cassette one at a time.

In front of the last infeed roller there is arranged a further sensing means 24, said sensing means being arranged to detect the complete passage of a banknote and to send a signal to the counter means and, with a given time delay, to the packing means. The packing means comprises a plate 12 arranged to co-act with an eccentric device 12*c* via a linkage system 12*a*, 12*b*. The infeed roller 16 and the packing means 12 are driven by separate motors 14 and 13, respectively.

The infeed unit is also provided with a cassette guiding and holding part. This part includes a recess 19*a* for accommodating the cover-plate 1*a* of the cassette. Subsequent to introducing the cassette cover-plate into said opening, the banknote part 1*b* of the cassette is pressed down to the infeed level for bank-notes, the cover-plate 1*a* remaining in the guiding position. The cover-plate 1*a* of the cassette and the banknote part 1*b* respectively cannot now be removed from their respective positions. When desiring to remove the cassette, the banknote part must be moved up towards the guiding position, so that the cover-plate completely covers the infeed opening 1*c* of the banknote part 1*b*.

Figure 2:
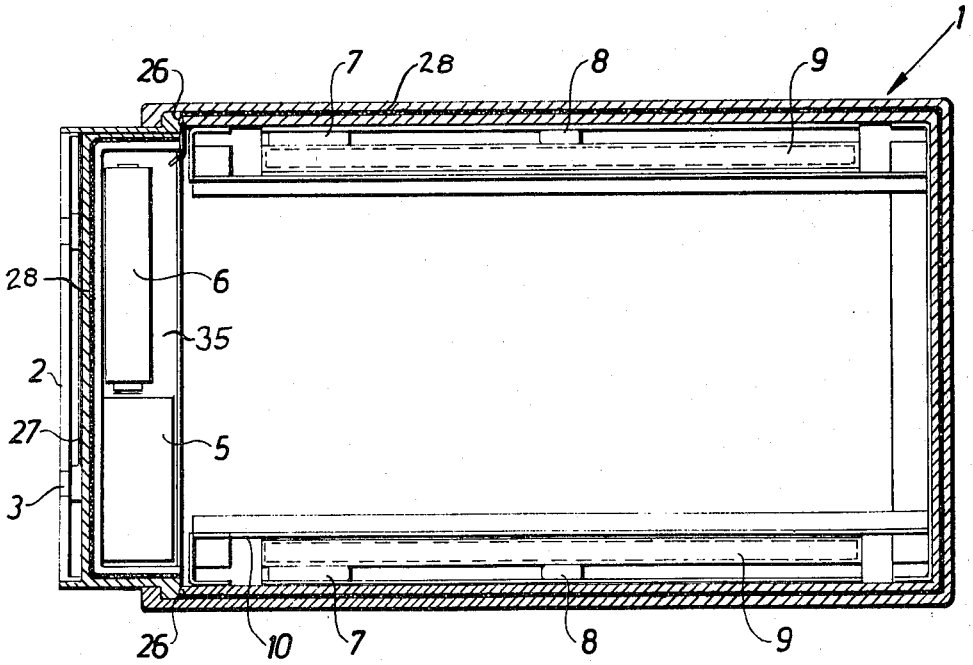
FIG. 2 is a horizontal cross-sectional view of a safety cassette according to the invention.

FIG. 2 is a cross-sectional view of a cassette with associated cover-plate 1*a* and banknote part 1*b*. The following elements are incorporated in the cover-plate 1*a*:

A conductive layer 28 comprising baked wire which has been double wound around a mould, heated and joined. The resultant sleeve has then been formed and inserted between an outer and inner casing, together with a plastics compound.

A chargeable battery 6.

A light conductor 27 and an opto-lock 3 with infrared control.

A circuit card 35, optionally of switch design to facilitate assembling.

Two switches 26 in the connecting surface to the banknote part 1*b*. These switches may optionally be gold-coated.

A micro-processor 5 for coordinating the electronic functions and light code.

The banknote part 1*b* of the cassette includes a conductive layer 28 of the same kind as that in the cover-plate. There is also provided a banknote holder 10 and two dye containers 9 extending along the longsides of the cassette. Arranged adjacent each of said containers 9 is a respective detonator 8. There is also provided two temperature sensors 7 and a sensing means (not shown) for detecting when the cassette is empty. Two switches 26 are arranged to co-operate with corresponding switches in the cover-plate.

When the safety functions are activated, the conductive layers 28 are connected to the current circuit. When an attempt is made to force the cassette, causing the conductive layer to be broken, the detonator is ignited.

The battery 6 may be a chargeable battery, and the capacity of the battery is regularly checked.

The cassette is also provided with an opto-lock which can be opened by an authorized person, by moving the light-sensing element 3 towards a device (not shown) having a light coding system. The safety functions are then de-activated, permitting the cassette to be opened.

The switches 26 located in the connecting surfaces between the cover-plate 1*a* and the banknote part 1*b* are arranged to ignite the detonator when an attempt is made to remove the cover-plate before first deactivating the safety functions.

When the cassette 1 is to be filled with banknotes, the infeed part of the infeed unit is located in its rearmost position. The cassette 1 is then introduced into the housing 19, the cover-plate 1*a* of the cassette being moved into the recess 19*a*. The banknote part 1*b* of the cassette is then moved down to the infeed level. The infeed part is then moved forwards, so that the packing means 12 enters the cassette. One or more banknotes is or are then placed on the infeed surface 18, whereafter the infeed of banknotes is initiated by closing a switch 22 arranged to activate the motor 14. The infeed sequence of banknotes is indicated in the display windows 21. The packing movements carried out by the packing means 12 are controlled by the infeed.

Subsequent to filling the cassette, the infeed part is moved to its rearward position. The cassette is them moved up to the insertion level, whereupon the cover-plate 1*a* completely covers the cassette infeed opening. The cassette can then be removed from the housing 19. Other kinds of cassettes and infeed units are possible within the scope of the concept of the invention. Instead of the infeed part of the infeed unit being displaceable, the banknote part of the cassette may be horizontally displaceable to an infeed position in the infeed unit.

An important advantage afforded by the method according to the invention is that, distinct from previously known systems for corresponding purposes, it offers progressive surety right from the time that the empty cassette is introduced into the infeed unit and the first banknote is introduced into the cassette, up to the time the cassette is opened and then handled by an authorized person. Any form of robbery is therefore doomed to failure from the outset. In the case, for example, of a theft from a store or the like equipped with an infeed unit, the thief is quite welcome to take the cassette with the banknotes therein from the infeed unit, since he is unable to remove the banknotes from the cassette in an undamaged state.

It will be understood that the cassettes are constructed to withstand normal handling and jolts and impacts of a minor nature without causing the liquid dye containers to be broken. Thus, the cassettes can be dropped onto the floor without the dye containers being broken.

I claim:

1. A method of providing safe control, storage and transport of banknotes when using a closeable cassette provided with a lock means and being of the kind which includes a container which has safety means with an electric circuit which is arranged, when an attempt is made to force the cassette open, to ignite a detonator causing a dye container or like element to rupture to thereby render the banknotes unusable, characterized by:

releasably connecting the cassette to a separate infeed unit, which is preferably provided with a counter, while exposing an infeed opening;

at least partially inserting an associated infeed and packing means (12) of the infeed unit into the infeed opening of the cassette;

introducing banknotes or other valuable sheets into the cassette;

releasing the at least partially filled cassette from the infeed unit while closing said opening and priming said safety means; and transporting the cassette to a collecting station, e.g. a bank, where an authorized person equipped with a key or having knowledge of the code for unlocking the cassette, empties the cassette of its contents.

2. A method according to claim 1, characterized by priming the electric safety means by automatically closing the infeed opening of the cassette when removing the cassette from the infeed unit.

3. A cassette for the safe control, storage and transportation of banknotes, said cassette comprising:

a closeable infeed opening (1*c*) having a lock means and a safety device with an electric circuit which is arranged when an attempt is made to force the cassette open, to ignite a detonator causing a dye container or like element to rupture to thereby render the banknotes unusable, said cassette (1) being configured for insertion into a separate banknote infeed unit (18, 19) while simultaneously exposing said infeed opening, said opening being arranged to be automatically closed when the cassette after being at least partially filled with banknotes is removed from the infeed unit, and switch means (26) adapted to be closed by the closure of said infeed opening (1*c*) when the cassette is removed from said infeed unit to actuate and prime said safety device.

4. A cassette according to claim 3, wherein the outer surfaces of the cassette are substantially smooth and lack any projecting part which could facilitate the forced opening of the cassette.

5. A cassette according to claim 3 or 4, wherein the cassette has a substantially parallelepipedic shape with a greatest length and width which slightly exceeds the length and width of the largest banknote intended to be stored in the cassette.

6. A cassette according to claim 5, wherein the depth of the cassette is less than 6 cm, preferably less than 5 cm.

7. A cassette according to claims 3 or 4, wherein the cassette is arranged to accommodate a banknote holder carrying a dye container (9), a detonator (8) and sensing means (28; 7), said holder having two longitudinally extending support edges arranged to co-operate with a packing plate in a manner such that a banknote fed into said cassette presses the packing plate upwardly from the bottom of the cassette.

8. An infeed unit for safe control and storing of banknotes, characterized in that said unit comprises:

a housing (19);

a cassette-receiving part arranged to permit a cassette (1) to be displaced to a banknote receiving position while exposing a supply opening (1*c*); and an infeed and packing part (12) which is movable relative to a cassette from an inactive position to an active position in which it is at least partly inserted into a banknote receiving part (1*b*) of the cassette.

9. An infeed unit according to claim 8, wherein said cassette-receiving part comprises a recess (19*a*) for accommodating a cover-plate (1*a*) of a cassette.

10. An infeed unit according to claim 8 or 9, wherein a cassette and the infeed and packing part (12) are displaceably movable relative to the housing in substantially perpendicular directions.

* * * * *